US011469544B2

(12) United States Patent
Liu et al.

(10) Patent No.: US 11,469,544 B2
(45) Date of Patent: Oct. 11, 2022

(54) BOOT SEALING A CABLE CONNECTOR

(71) Applicant: CommScope Technologies LLC, Hickory, NC (US)

(72) Inventors: Jin Liu, Jiangsu (CN); MuLan Huang, Jiangsu (CN); Li Zhang, Jiangsu (CN); Yujun Zhang, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/891,293

(22) Filed: Jun. 3, 2020

(65) Prior Publication Data

US 2020/0388954 A1 Dec. 10, 2020

(30) Foreign Application Priority Data

Jun. 5, 2019 (CN) ..... 201910483670.6

(51) Int. Cl.
*H01R 13/52* (2006.01)

(52) U.S. Cl.
CPC ..... *H01R 13/5221* (2013.01)

(58) Field of Classification Search
CPC ..... H01R 13/5221; H01R 13/5213; H01R 13/5219; H01R 43/005; H02G 15/013; H02G 15/043
See application file for complete search history.

(56) References Cited

U.S. PATENT DOCUMENTS 3,668,612 A 6/1972 Zdenek
4,063,793 A * 12/1977 Judd ..... H01R 13/5205 439/588

(Continued)

FOREIGN PATENT DOCUMENTS

WO 2005069710 A1 7/2005

OTHER PUBLICATIONS

"International Search Report and Written Opinion corresponding to International Application No. PCT/US2020/035850 dated Sep. 15, 2020".

*Primary Examiner* — Vanessa Girardi
(74) *Attorney, Agent, or Firm* — Myers Bigel, P.A.

(57) ABSTRACT

The present invention relates to a boot and connector assembly. The boot has a through hole passing therethrough and a boot body enclosing the through hole, the boot body comprising: a neck sealing portion presenting a substantially cylindrical shape, wherein the neck sealing portion has an inner diameter maintained substantially constant; a body portion located at the proximal side of the neck sealing portion and presenting a generally cylindrical shape, wherein the body portion has an inner diameter and an outer diameter that are both greater than the inner diameter and the outer diameter of the neck sealing portion; and a gap passing portion connecting the neck sealing portion to the body portion and having a substantially frustoconical shape, wherein the gap passing portion has an inner diameter gradually increasing from the inner diameter of the neck sealing portion to the inner diameter of the body portion, and an outer diameter gradually increasing from the outer diameter of the neck sealing portion to the outer diameter of the body portion. The boot of the present disclosure effectively solves the problem that the boot interferes with other components so that the boot is unable to extend to the antenna panel when the mounting space is small, and also has the advantages of simple to manufacture, convenient to mount and high efficiency.

20 Claims, 4 Drawing Sheets

(56) References Cited

U.S. PATENT DOCUMENTS

| | | | | |
|---|---|---|---|---|
| 4,869,679 | A | 9/1989 | Szegda | |
| 7,097,500 | B2 * | 8/2006 | Montena | H01R 13/5219 439/587 |
| 7,674,121 | B2 * | 3/2010 | Khemakhem | H01R 13/5213 439/135 |
| 9,106,003 | B2 * | 8/2015 | Anderson | H01R 13/5213 |
| 2009/0291580 | A1 * | 11/2009 | Burris | H01R 13/5219 439/320 |
| 2016/0178850 | A1 | 6/2016 | Nhep | |
| 2017/0250497 | A1 | 8/2017 | Antonini et al. | |

* cited by examiner

BOOT SEALING A CABLE CONNECTOR

RELATED APPLICATION

The present application claims priority from and the benefit of Chinese Patent Application No. 201910483670.6, filed Jun. 5, 2019, the disclosure of which is hereby incorporated herein in its entirety.

TECHNICAL FIELD

The present disclosure generally relates to the field of cable connection. More specifically, the present disclosure relates to a boot that seals a cable connector interface against ambient environmental influences and a connector assembly.

BACKGROUND ART

Cable connectors are susceptible to cyclic expansion and contraction arising from complex factors such as light, moisture, vibration, and daily temperature changes during outdoor use, thereby leading to aging, especially when applied to the connection portions of high-altitude outdoor antenna ends. Accordingly, various boots have been used at present to protect, for example, connectors between two cable ends or connectors between the cable end and the device panel.

The prior art typically uses a boot of a rigid housing construction (such as a high-hardness plastic material) that, once closed, is difficult to be opened again, especially when installed at an exposed position such as the tower top of a communication base station. A boot made of an elastomer is also known. FIG. 1 shows a cross-sectional view of an existing elastomeric boot 10 (see, e.g., U.S. Pat. No. 10,090,661). However, with the development of communication technologies, multi-band and multi-port devices are becoming more and more widely used, especially with an increasing number of various connection ports on the antenna and an even more compact layout of connectors on a device panel of the same dimension, so that the boot 10 might be unable to fit within the available space to complete installation at a position proximate to an edge of the device panel. For example, as shown in FIG. 2, the connector interface 20 is adjacent and relatively close to the outer protective cover 1 of the remote radio unit (RRU), which results in that the neck sealing portion 11 of the boot 10 being unable to fully project into the gap between the outer protective cover plate 1 and the connector interface 20 to finish the installation.

One solution for the above problem is to sleeve a sealing ring 2 around the outer circumference of the neck section 21 of the connector interface 20, as shown in FIG. 3. The neck sealing portion 11 of the boot 10 only needs to abut against a portion of the sealing ring 2 to enable the sealing without fully projecting into the gap between the outer protective cover plate 1 and the connector interface 20. Such solution results in an increased number of members and mounting steps, and the sealing ring 2 increases the outer diameter of the neck section 21, thereby increasing the outer dimension of the boot 10.

SUMMARY

The present disclosure provides a cable connector boot that is able to overcome at least one of the above-described defects of the existing products.

The subject technology is illustrated according to various aspects described below. Various examples of accepts of the subject technology are described as numbered clauses (1, 2, 3, etc) for convenience. These are provided as examples and do not limit the subject technology.

As a first aspect, embodiments of the invention are directed to a boot for sealing a connector interface between a cable and a panel, wherein, the boot has a through hole passing therethrough and a boot body enclosing the through hole, the boot body comprising: a neck sealing portion presenting a substantially cylindrical shape, wherein the neck sealing portion has an inner diameter maintained substantially constant; a body portion located at the proximal side of the neck sealing portion and presenting a generally cylindrical shape, wherein the body portion has an inner diameter and an outer diameter that are both greater than the inner diameter and the outer diameter of the neck sealing portion; and a gap passing portion connecting the neck sealing portion to the body portion and having a substantially frustoconical shape, wherein the gap passing portion has an inner diameter gradually increasing from the inner diameter of the neck sealing portion to the inner diameter of the body portion, and an outer diameter gradually increasing from the outer diameter of the neck sealing portion to the outer diameter of the body portion.

In some embodiments, the boot further comprises a guide portion located at the distal side of the neck sealing portion and connected to the neck sealing portion, wherein the guide portion presents a substantially cylindrical shape and has a thickness gradually increasing from the distal end toward the proximal end.

In some embodiments, the guide portion has an outer diameter maintained substantially constant and an inner diameter decreasing at a uniform rate or at a non-uniform rate from the distal end toward the proximal end.

In some embodiments, the guide portion is divided into a plurality of segments, wherein the inner diameters of the plurality of segments decreases at uniform rates different from one another from the distal end toward the proximal end.

In some embodiments, the guide portion has an outer diameter that is substantially the same as that of the neck sealing portion.

In some embodiments, the boot further comprises a cable sealing portion located at the proximal side of the body portion and connected to the body portion, wherein the cable sealing portion presents a substantially cylindrical shape and has an inner diameter maintained substantially constant.

In some embodiments, the cable sealing portion is connected to the body portion by a shoulder and has an inner diameter smaller than that of the body portion.

In some embodiments, the cable sealing portion has a smooth inner surface or an inner surface with internal threads.

In some embodiments, the cable sealing portion has a substantially uniform thickness.

In some embodiments, the neck sealing portion has a substantially uniform thickness.

In some embodiments, the gap passing portion has a substantially uniform thickness.

In some embodiments, the body portion has a substantially uniform thickness.

In some embodiments, the body portion has an inner diameter maintained substantially constant or uniformly varying between the gap passing portion and the cable sealing portion.

In some embodiments, the boot has an outer surface on which rib-like projections are arranged perpendicular to the longitudinal direction.

In some embodiments, the cross section of the boot presents a substantially circular ring shape.

In some embodiments, the boot is integral, or separately formed and joined together.

In some embodiments, the boot is made from an elastomeric material.

As a second aspect, embodiments of the invention are directed to a connector assembly, the connector assembly comprises: a boot as described above; and a connector capable of connecting a cable to a panel and forming a connector interface together with the cable and the panel, wherein the connector interface sequentially includes a neck section, an enlarged section, a body section, and a cable section from the distal end to the proximal end; wherein a neck sealing portion of the boot seals the neck section of the connector interface, and a body portion of the boot substantially surrounds the enlarged section and the body section of the connector interface.

In some embodiments, the connector includes a cable connector and a panel connector that are plugged within each other.

In some embodiments, the cable connector and the panel connector are connected together by a nut, and the portion of the cable connector and the panel connector assembled together which is provided with the nut corresponds to the enlarged section of the connector interface, wherein a distal side and a proximal side of the enlarged section respectively correspond to the neck section and the body section of the connector interface.

BRIEF DESCRIPTION OF THE DRAWINGS

After reading the embodiments hereinafter in combination with the drawings, a plurality of aspects of the present disclosure will be better understood. In the drawings.

DESCRIPTION OF THE INVENTION

Figure 1:
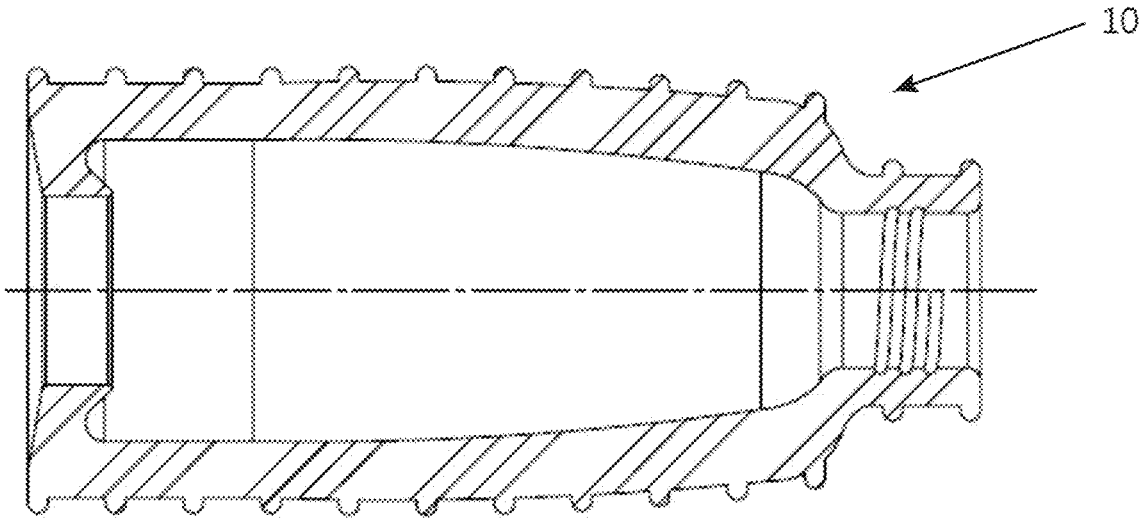
FIG. 1 (Prior Art)
FIG. 1 shows a cross-sectional view of an existing boot.
Figure 2:
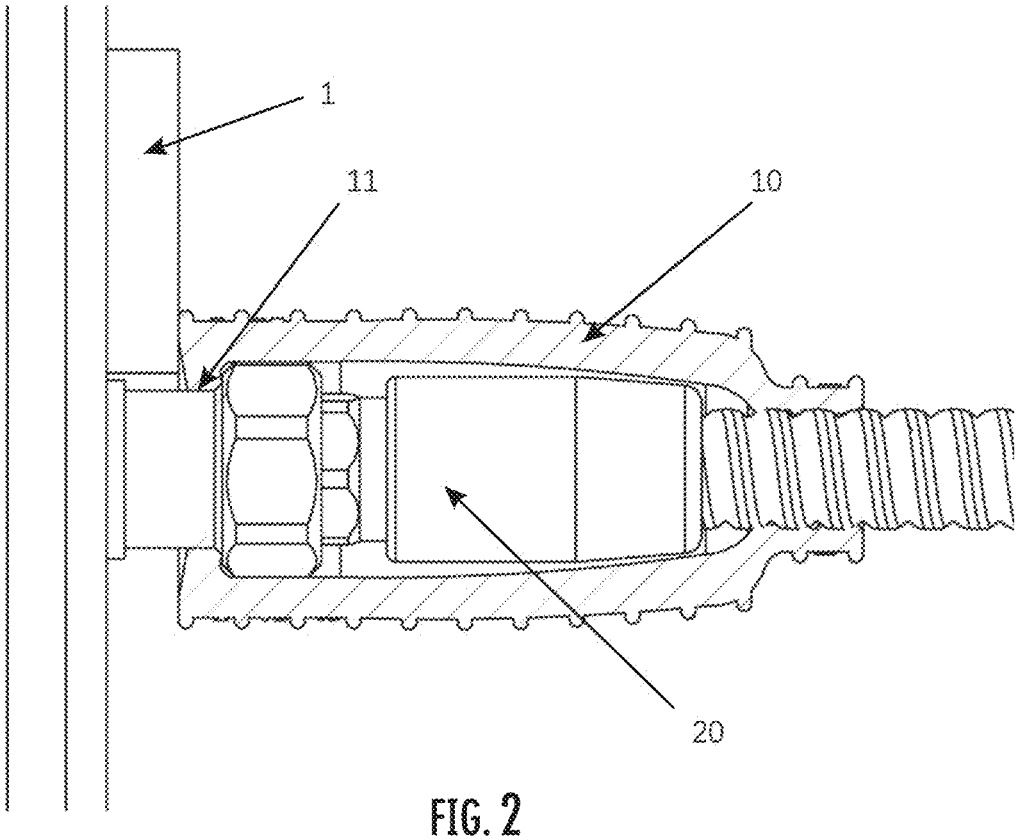
FIG. 2 (Prior Art)
FIG. 2 shows a cross-sectional view of the existing boot of FIG. 1 when interfering a panel projection so that the installation cannot be completed.
Figure 3:
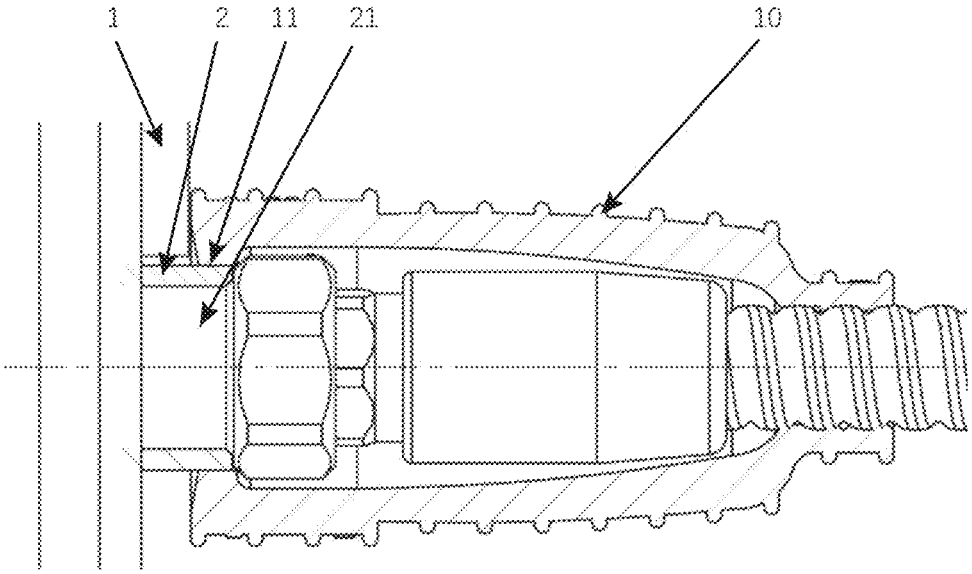
FIG. 3 (Prior Art)
FIG. 3 shows a cross-sectional view of a connector assembly mounted with a sealing ring and an existing boot, in the case where there is a panel projection of FIG. 2.

The present disclosure will be described below with reference to the drawings, in which several embodiments of the present disclosure are shown. It should be understood, however, that the present disclosure may be presented in multiple different ways, and not limited to the embodiments described below. In fact, the embodiments described hereinafter are intended to make a more complete disclosure of the present disclosure and to adequately explain the protection scope of the present disclosure to a person skilled in the art. It should also be understood that, the embodiments disclosed herein can be combined in various ways to provide more additional embodiments.

It should be understood that, in all the drawings, the same reference numbers indicate the same elements. In the drawings, for the sake of clarity, the sizes of certain features may be deformed.

It should be understood that, the wording in the specification is only used for describing particular embodiments and is not intended to define the present disclosure. All the terms used in the specification (including the technical terms and scientific terms), have the meanings as normally understood by a person skilled in the art, unless otherwise defined. For the sake of conciseness and/or clarity, the well-known functions or constructions may not be described in detail any further.

The singular forms "a/an", "said" and "the" as used in the specification, unless clearly indicated, all contain the plural forms as well. The wordings "comprising", "containing" and "including" used in the specification indicate the presence of the claimed features, but do not repel the presence of one or more other features. The wording "and/or" as used in the specification includes any and all combinations of one or more of the relevant items listed. The phrases "between X and Y" and "between around X and Y" as used in the specification should be construed as including X and Y. The phrase "between about X and Y" as used in the present specification means "between about X and about Y", and the phrase "from about X to Y" as used in the present specification means "from about X to about Y".

In the specification, when one element is referred to as being "on" another element, "attached to" another element, "connected to" another element, "coupled to" another element, or "in contact with" another element, the element may be directly located on another element, attached to another element, connected to another element, coupled to another element, or in contact with another element, or there may be an intermediate element. By contrast, when one element is referred to as being "directly" on another element, "directly attached to" another element, "directly connected to" another element, "directly coupled to" another element, or "in direct contact with" another element, there will not be an intermediate element. In the specification, when one feature is arranged to be "adjacent" to another feature, it may mean that one feature has a portion that overlaps with an adjacent feature or a portion that is located above or below an adjacent feature.

In the specification, the spatial relation wordings such as "up", "down", "left", "right", "forth", "back", "high", "low" and the like may describe a relation of one feature with another feature in the drawings. It should be understood that, the spatial relation wordings also contain different orientations of the apparatus in use or operation, in addition to containing the orientations shown in the drawings. For example, when the apparatus in the drawings is overturned, the features previously described as "below" other features may be described to be "above" other features at this time. The apparatus may also be otherwise oriented (rotated 90 degrees or at other orientations). At this time, the relative spatial relations will be explained correspondingly.

Figure 4:
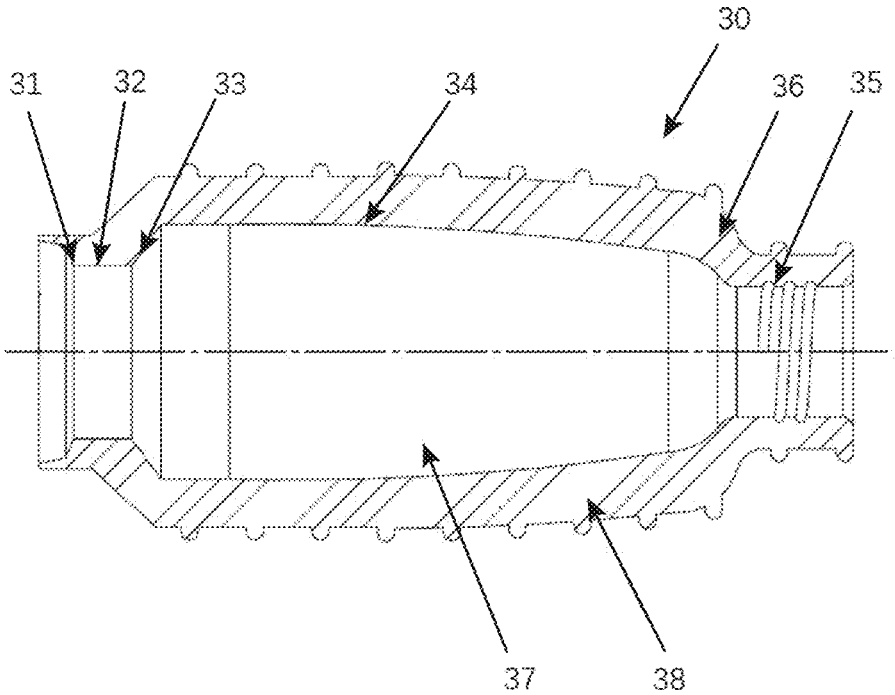
FIG. 4 shows a cross-sectional view of a boot according to one embodiment of the present invention.

FIG. 4 shows a boot 30 according to one embodiment of the present disclosure. The boot 30 is used to provide an effective sealing for the connector interface 40 between the cable 3 and the panel 4, thereby prevent water and other foreign objects from accessing the connector interface 40. As shown, the boot 30 presents a hollow, generally cylindrical shape, and has a through hole 37 located in the center and a boot body 38 enclosing the through hole 37, so as to accommodate various sections of the connector interface 40 between the cable 3 and the panel 44. In one embodiment, the cross-sections of the boot 30 may be substantially annular.

Figure 5:
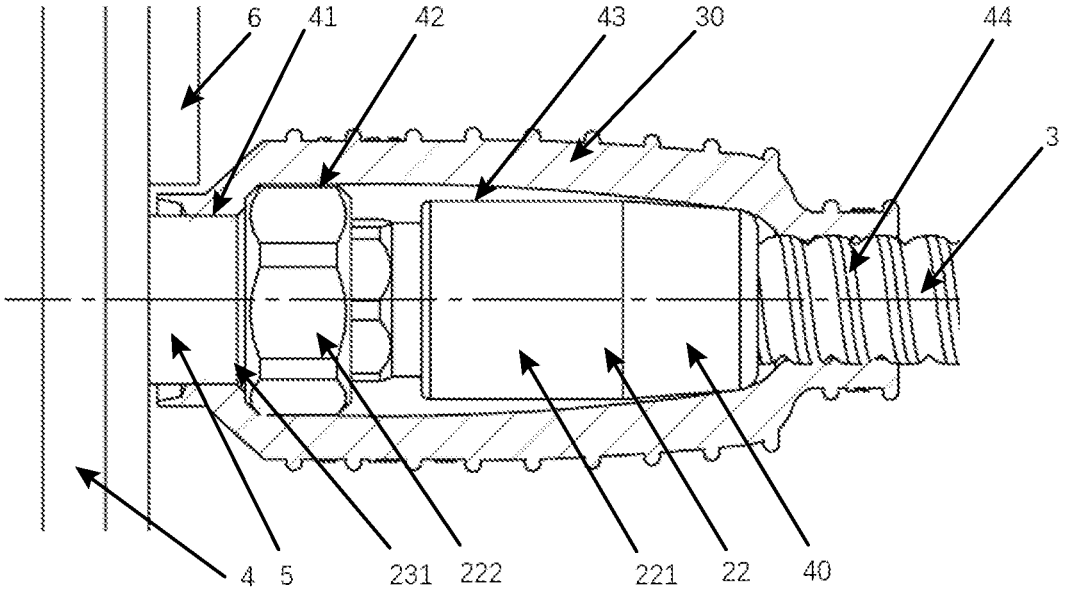
FIG. 5 shows a cross-sectional view of an assembled connector assembly according to one embodiment of the present invention.

FIG. 5 shows an example of a connector interface 40 between a cable 3 and a panel 4, and the boot 30 may be mounted over the connector interface 40. As shown, in such connector interface 40, a cable connector 22 is used to mechanically and electrically connect the cable 3 to a panel connector 5 on the panel 4, such as a base station antenna panel.

The connector interface 40 between the cable 3 and the panel 4 includes a distal end proximate to the panel 4 and a proximal end proximate to the cable 3. Those skilled in the art will appreciate that the distal and proximal ends provide a positional reference for the connector interface 40 and boot 30 in the longitudinal direction of the connector interface 40. Each element has a distal end and a proximal end to indicate the positions of the element closest to the proximal and distal ends of the connector interface 40 along the longitudinal axis of the connector interface 40 respectively.

As shown in FIG. 5, the cable connector 22 is located at the proximal side and connected to the cable 3, while the panel connector 5 is located at the distal side and fixed to the panel 4. The cable connector 22 includes a housing 221 and a nut 222 that surrounds the distal end of the housing 221. The housing 221 includes a through hole located in the center, and a distal end portion of the cable 3 may be inserted and fixed in the through hole. The panel connector 5 includes a hollow housing 231 with external threads on a proximal end that can receive the housing 221 of the cable connector 22. By inserting the housing 221 of the cable connector 22 into a cavity of the hollow housing 231 of the panel connector 5, and screwing the nut 222 of the cable connector 22 on the external threads of the hollow housing 231 of the panel connector 5, the cable connector 22 may be connected to the panel connector 5 so as to mechanically and electrically connect the cable 3 to the panel 4.

The connector interface 40 between the cable 3 and the panel 4 sequentially includes a neck section 41, an enlarged section 42, a body section 43, and a cable section 44 from the distal end to the proximal end. Typically, the outer diameter of the enlarged section 42 is larger than the outer diameters of the other sections. In one embodiment, the neck section 41 of the connector interface 40 corresponds to a portion of the housing of the panel connector 5; the enlarged section 42 of the connector interface 40 corresponds to the portion by which the external threads of the panel connector 5 are engaged with the nut 222 of the cable connector 22 by screw connection; the body section 43 of the connector interface 40 corresponds to a portion of the housing 221 of the cable connector 22; and the cable section 44 of the connector interface 40 corresponds to a section of exposed cable 3 that is connected to the cable connector 22. The connector interface 40 is adjacent to the projection 6 on the panel 4 (e.g., the outer protective cover plate of the RRU) with a small gap therebetween.

Correspondingly, the boot 30 sequentially includes a guide portion 31, a neck sealing portion 32, a gap passing portion 33, a body portion 34, and a cable sealing portion 35 from the distal end to the proximal end, as shown in FIGS. 4 and 5. The outer diameter of the body portion 34 located in the middle is large, the outer diameter of the guide portion 31 and the neck sealing portion 32 that are located at the distal side, as well as the cable sealing portion 35 located at the proximal side are small, while the outer diameter of the gap passing portion 33 gradually increases from the distal end to the proximal end, so as to connect the neck sealing portion 32 and the body portion 34.

The guide portion 31 is located at the most distal end of the boot 30 and serves to guide the neck sealing portion 32 of the boot 30 to advance towards the enlarged portion 42 of the connector interface 40. The guide portion 31 has a substantially cylindrical shape, and the thickness of which gradually increases from the distal end to the proximal end. In one embodiment, the outer diameter of the guide portion 31 remains substantially constant. The inner diameter of the guide portion 31 is substantially equal to the outer diameter of the enlarged portion 42 of the connector interface 40 at the distal end, and is reduced towards the proximal end to be substantially the same as the outer diameter of the neck section 41 of the connector interface 40, thereby forming a ramp structure. The inner diameter of the guide portion 31 may decrease at a uniform rate from the distal end to the proximal end, or decrease at a varying rate. In one embodiment, the guide portion 31 may be divided into a plurality of segments (e.g., two segments), wherein the plurality of segments have inner diameters decreasing at uniform rates different from one another.

The neck sealing portion 32 is connected to the guide portion 31 at the distal end of the neck sealing portion 32 and serves to closely fit around the neck section 41 of the connector interface 40, so as to form a sealing of the neck section 41. The neck sealing portion 32 has a substantially cylindrical shape and a thickness maintained substantially uniform. The inner diameter of the neck sealing portion 32 is configured to be slightly smaller than the outer diameter of the neck section 41 of the connector interface 40 and maintained substantially constant, thereby enabling to closely fit around the neck section 41. The outer diameter of the neck sealing portion 32 is maintained substantially constant and is substantially the same as the outer diameter of the guide portion 31.

The gap passing portion 33 is connected to the neck sealing portion 32 at the distal end of the gap passing portion 33 and serves to drive the boot 30 to pass through the gap between the connector interface 40 and the panel projection 6. The gap passing portion 33 has a substantially frusto-conical shape and a thickness maintained substantially uniform. The thickness of the gap passing portion 33 is configured to be able to pass through the gap between the connector interface 40 and the panel projection 6. The inner and outer diameters of the gap passing portion 33 gradually increase from the distal end to the proximal end so as to transition from the smaller inner and outer diameters of the neck sealing portion 32 to the larger inner and outer diameters of the body portion 34.

The body portion 34 is connected to the gap passing portion 33 at the distal end of the body portion 34 and serves to enclose the enlarged section 42 and the body section 43 of the connector interface 40. The body portion 34 has a substantially cylindrical shape, and may have a substantially uniform thickness. The body portion 34 is generally configured to have a larger inner diameter than the neck sealing portion 32 such that the body portion 34 can enclose the enlarged section 42 with an outer diameter that is larger than the inner diameter of the neck sealing portion 32. The body portion 34 may be configured to have an inner diameter that varies uniformly from the gap passing portion 33 to the cable sealing portion 35, so as to vary by conforming to the outer shape of the body section 43, and at the same time may simplify the molding and/or the demolding process(es). Of course, the inner diameter of the body portion 34 may also be appropriately adjusted according to actual needs, so as to adapt to connectors of different configurations. The body portion 34 has the largest outer diameter among the different portions of the boot 30, and the outer diameter may be maintained substantially constant, or gradually increase or gradually decrease from the distal end to the proximal end.

The cable sealing portion 35 is connected to the body portion 34 through a shoulder 36 at the distal end of the cable sealing portion, for closely fitting around the cable 3 so as to form a sealing of the cable 3. The outer diameter of the cable sealing portion 35 is maintained substantially constant, and the inner diameter is configured to be slightly smaller than the outer diameter of the cable 3 and maintained substantially constant, thereby closely fitting around the outer surface of the cable 3.

The neck sealing portion 32 and/or the cable sealing portion 35 may have a smooth inner surface so as to maximize the contact area between the neck sealing portion 32 and the outer surface of the neck section 41 of the connector interface 40 and/or between the cable sealing portion 35 and the outer surface of the cable 3, such that the sealing formed by the contact area can prevent leakage to a maximum extent. Alternatively, when the outer surface of the cable 3 has threads or corrugations, the inner surface of the cable sealing portion 35 may be configured to have corresponding internal threads or grooves that may or may not mate with the threads or corrugations of the cable 3.

The neck sealing portion 32, the gap passing portion 33, the body portion 34, and the cable sealing portion 35 may each have a substantially uniform thickness. In some embodiments, the transition portions of every two adjacent portions are configured to be appropriately thickened due to changes in the inner and outer diameters which lead to the susceptibility to a bending stress.

The boot 30 has an outer surface on which rib-like projections may be arranged perpendicular to the longitudinal direction, so as to facilitate gripping by an operator.

The boot 30 may be integral, or may be separately formed and connected together by known methods. In one embodiment, the boot 30 may be integrally formed of a resilient material, for example, may be formed by injection molding a material, such as silicone rubber, thermoplastic elastomer, and the like, which have proper sealing property, environmental defending capability and stability. At the same time, these materials possess certain hardness to maintain the dimensional stability of several portions of the boot 30 before and during use. Additionally, these materials possess certain resilience such that at least the neck sealing portion 32 can be stretched over the enlarged section 42 of the connector interface 40 when the boot 30 is being mounted on the connector interface 40.

Figure 6:
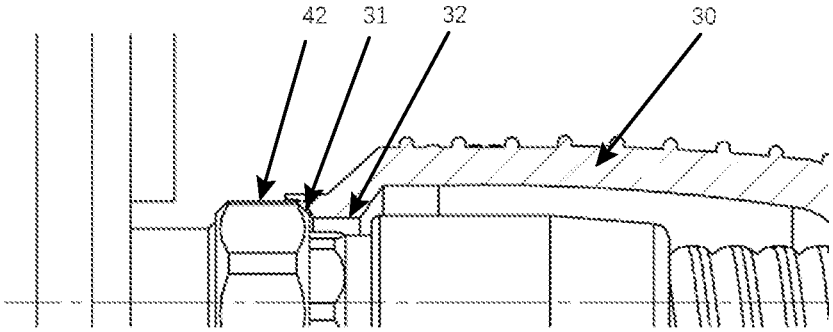
FIG. 6 shows a cross-sectional view when a guide portion of a boot is ready to pass over an enlarged section during the installation of a connector assembly of FIG. 5.
Figure 7:
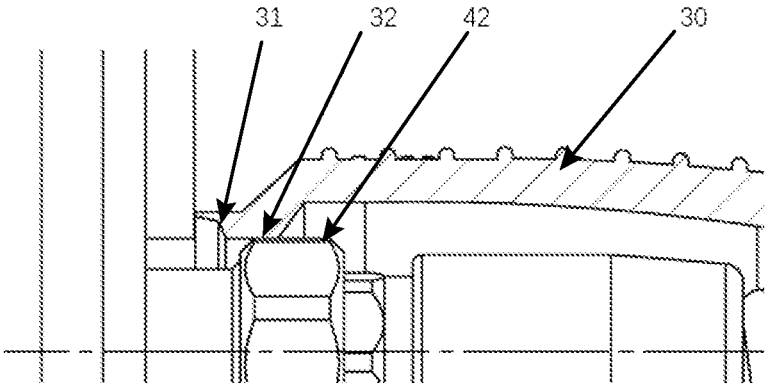
FIG. 7 shows a cross-sectional view when a neck sealing portion of a boot passes over an enlarged section during the installation of a connector assembly of FIG. 5.
Figure 8:
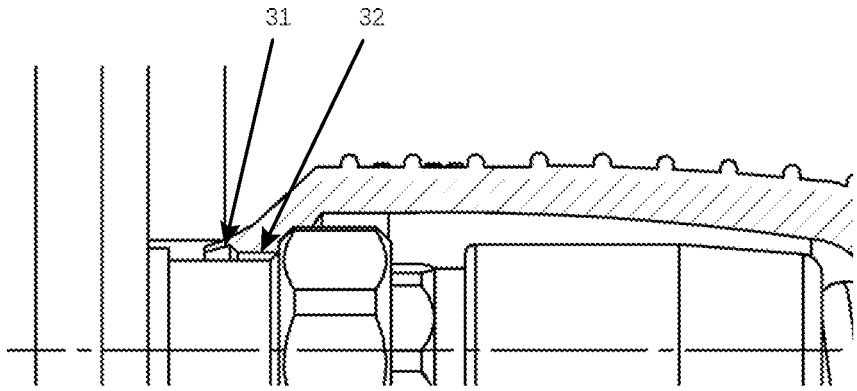
FIG. 8 shows a schematic cross-sectional view of a front end of a guide portion of a boot engaging a panel projection to collapse radially inwards during the installation of a connector assembly of FIG. 5.
Figure 9:
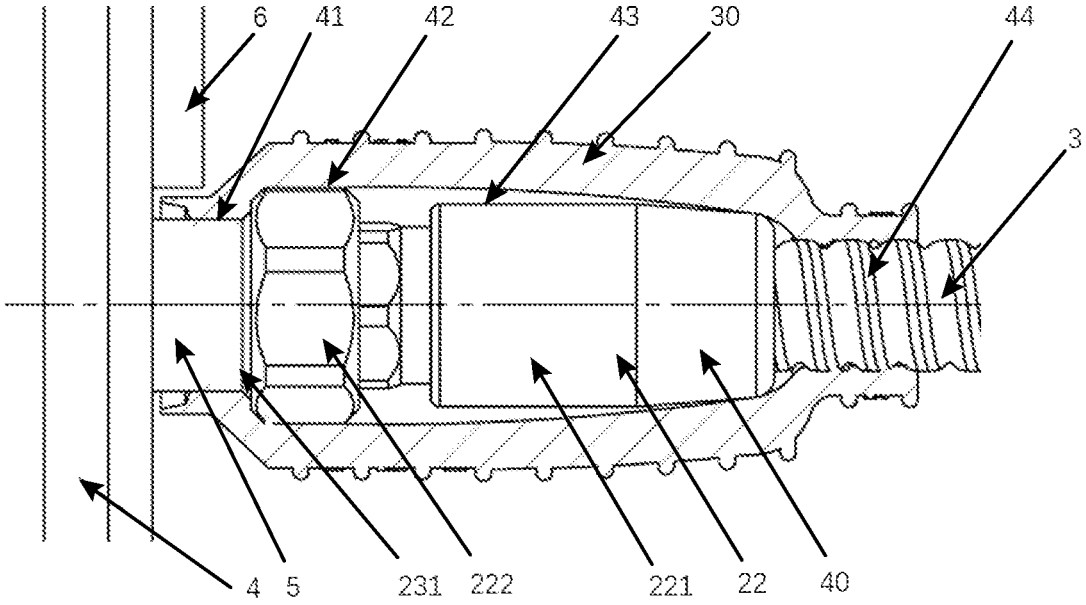
FIG. 9 shows a cross-sectional view when the installation of a connector assembly of FIG. 5 is completed.

The steps of mounting the boot 30 on the connector interface 40 between the cable 3 and the panel 4 are introduced below. First, the operator sleeves the boot 30 on the connector interface 40 and advances the same from the proximal end to the distal end. As shown in FIG. 6, when the guide portion 31 of the boot 30 reaches the enlarged section 42 of the connector interface 40, the distal end of the guide portion 31 overlaps on the enlarged section 42. By proper rotation, the guide portion 31 gradually advances onto the enlarged section 42 by the ramp structure of the inner surface of the guide portion 31, and thereby driving the neck sealing portion 32 of the boot 30 to advances onto the enlarged section 42. As shown in FIG. 7, when the neck sealing portion 32 of the boot 30 advances onto the enlarged section 42, the resilient property of the boot 30 enables the neck sealing portion 32 to stretch radially outwards to a certain extent so as to enclose the enlarged section 42. The guide portion 31 and the neck sealing portion 32 are further advanced towards the distal end until the end portion of the guide portion 31 abuts against the outer surface of the panel projection 6. As shown in FIG. 8, the boot 30 is rotated and the boot 30 is advanced towards the distal end, such that the guide portion 31 will collapse radially inwards, and drive the neck sealing portion 32 and the gap passing portion 33 to pass through the gap between the connector interface 40 and the panel projection 6. After passing through the gap and completely over the enlarged section 42, the neck sealing portion 32 will retract by its own resilience to closely fit around the neck section 41 of the connector interface 40 and form a sealing, as shown in FIG. 9. After the neck sealing portion 32 passes over the entire enlarged section 42, the operator may appropriately stretch and rotate the boot 30 towards the proximal direction to achieve an optimum mating between various portions of the boot 30 and the various sections of the connector interface 40. That is, the neck sealing portion 32 of the boot 30 is closely fitted around the neck section 41 of the connector interface 40 to form a sealing, and the cable sealing portion 35 of the boot 30 is closely fitted around the cable section 44 of the connector interface 40 to form a sealing, and the body portion 34 encloses the enlarged section 42 and the body section 43 of the connector interface 40.

Those skilled in the art will appreciate that, the relationship of the diameters among various sections of the connector interface 40 is merely exemplary. Alternatively, the cable section 44 and/or the body section 43 may also have a larger diameter than the enlarged section 42, such that boot 30 is correspondingly configured to have an inner diameter increasing from the gap passing portion 33 to the cable sealing portion 35 and/or to the body portion 34.

From the above descriptions, it is apparent that, the boot of the present disclosure effectively solves the problem that the boot interferes with other components so that the boot is unable to extend to the antenna panel when the mounting space is small, and also has the advantages of simple to manufacture, convenient to mount and high efficiency.

Although the exemplary embodiments of the present disclosure have been described, a person skilled in the art should understand that, he or she can make multiple changes and modifications to the exemplary embodiments of the present disclosure without substantively departing from the spirit and scope of the present disclosure. Accordingly, all the changes and modifications are encompassed within the protection scope of the present disclosure as defined by the claims. The present disclosure is defined by the appended claims, and the equivalents of these claims are also contained therein.

What is claimed is:

1. A method of sealing a connector interface between a cable and a panel with a boot, wherein the boot comprises a body having a through hole, a neck sealing portion, a gap passing portion connecting the neck sealing portion to a distal portion of the body, and a guide portion connected to a distal side of the neck sealing portion, wherein the guide portion has a substantially cylindrical shape and is configured to collapse radially inwards when a distal end thereof abuts a surface, the method comprising:

sleeving the boot on the cable;

advancing the boot over the connector interface until the guide portion of the boot abuts the panel; then rotating the boot to cause the guide portion to collapse radially inwards such that the guide portion has a substantially conical shape, and without deforming the neck sealing portion or gap passing portion; and then further advancing the boot through a gap between the connector interface and the panel to seal the connector interface and such that the guide portion returns to the substantially cylindrical shape.

2. A boot for sealing a connector interface between a cable and a panel, the boot comprising:

a body portion defining a passageway for receiving the cable therethrough, the body portion having a proximal end portion and an opposite distal end portion;

wherein the distal end portion has a cylindrical shape and a thickness that gradually increases in a direction toward the proximal end portion such that, when the distal end portion abuts a surface of the panel, the distal end portion is configured to collapse radially inward without deforming the body portion and such that the distal end portion has a substantially conical shape, and then return to the cylindrical shape as the distal end portion is moved through a gap between the connector interface and the panel to seal the connector interface between the cable and the panel.

3. A boot for sealing a connector interface between a cable and a panel, characterized in that, the boot has a through hole passing therethrough and a boot body enclosing the through hole, the boot body comprising:

a neck sealing portion presenting a substantially cylindrical shape, wherein the neck sealing portion has an inner diameter maintained substantially constant;

a body portion located at a proximal side of the neck sealing portion and presenting a generally cylindrical shape, wherein the body portion has an inner diameter and an outer diameter that are both greater than the inner diameter and an outer diameter of the neck sealing portion;

a gap passing portion connecting the neck sealing portion to the body portion and having a substantially frustoconical shape, wherein the gap passing portion has an inner diameter gradually increasing from the inner diameter of the neck sealing portion to the inner diameter of the body portion, and an outer diameter gradually increasing from the outer diameter of the neck sealing portion to the outer diameter of the body portion; and a guide portion located at a distal side of the neck sealing portion and connected to the neck sealing portion, wherein the guide portion presents a substantially cylindrical shape and has a thickness gradually increasing from a distal end thereof toward a proximal end thereof such that an inner surface of the guide portion has a ramp structure, and wherein the guide portion has an outer diameter that is the same as that of the neck sealing portion.

4. The boot according to claim 3, characterized in that, the neck sealing portion has a substantially uniform thickness.

5. The boot according to claim 3, characterized in that, the gap passing portion has a substantially uniform thickness.

6. The boot according to claim 3, characterized in that, the body portion has a substantially uniform thickness.

7. The boot according to claim 3, characterized in that, the body portion has an inner diameter maintained substantially constant or uniformly varying between the gap passing portion and the cable sealing portion.

8. The boot according to claim 3, characterized in that, the boot has an outer surface on which rib-like projections are arranged perpendicular to the longitudinal direction.

9. The boot according to claim 3, characterized in that, the cross section of the boot presents a substantially circular ring shape.

10. The boot according to claim 3, characterized in that, the boot is integral, or separately formed and joined together.

11. The boot according to claim 3, characterized in that, the boot is made from an elastomeric material.

12. The boot according to claim 3, characterized in that, the guide portion has an outer diameter maintained substantially constant and an inner diameter decreasing at a uniform rate from the distal end toward the proximal end.

13. The boot according to claim 12, characterized in that, the guide portion is divided into a plurality of segments, wherein the inner diameters of the plurality of segments decreases at uniform rates different from one another from the distal end toward the proximal end.

14. The boot according to claim 3, characterized in that, the boot body further comprises a cable sealing portion located at a proximal side of the body portion and connected to the body portion, wherein the cable sealing portion presents a substantially cylindrical shape and has an inner diameter maintained substantially constant.

15. The boot according to claim 14, characterized in that, the cable sealing portion is connected to the body portion by a shoulder and has an inner diameter smaller than that of the body portion.

16. The boot according to claim 14, characterized in that, the cable sealing portion has a smooth inner surface or an inner surface with internal threads.

17. The boot according to claim 14, characterized in that, the cable sealing portion has a substantially uniform thickness.

18. A connector assembly, characterized in that, the connector assembly comprises:

a boot according to claim 3; and a connector capable of connecting a cable to a panel and forming a connector interface together with the cable and the panel, wherein the connector interface sequentially includes a neck section, an enlarged section, a body section, and a cable section from the distal end to the proximal end;

wherein the neck sealing portion of the boot seals the neck section of the connector interface, and the body portion of the boot substantially surrounds the enlarged section and the body section of the connector interface.

19. The connector assembly according to claim 18, characterized in that, the connector includes a cable connector and a panel connector that are plugged within each other.

20. The connector assembly according to claim 19, characterized in that, the cable connector and the panel connector are connected together by a nut, and the portion of the cable connector and the panel connector assembled together which is provided with the nut corresponds to the enlarged section of the connector interface, wherein a distal side and a proximal side of the enlarged section respectively correspond to the neck section and the body section of the connector interface.

* * * * *